US006511046B1

(12) United States Patent
Solakian

(10) Patent No.: US 6,511,046 B1
(45) Date of Patent: Jan. 28, 2003

(54) RESILIENT AIR COMPRESSIBLE APPARATUS

(76) Inventor: Harry M. Solakian, 2657 N. Argyle, Fresno, CA (US) 93727

( * ) Notice: Subject to any disclaimer, the term of this patent is extended or adjusted under 35 U.S.C. 154(b) by 0 days.

(21) Appl. No.: 09/819,531

(22) Filed: Mar. 27, 2001

Related U.S. Application Data

(63) Continuation of application No. 09/316,915, filed on May 20, 1999, now abandoned.

(51) Int. Cl.[7] ..... B66F 3/24
(52) U.S. Cl. ..... 254/93 HP
(58) Field of Search ..... 254/93 H; 92/34, 92/35, 42; 267/122, 69.27, 69.23, 69.19

(56) References Cited

U.S. PATENT DOCUMENTS 2,070,960 A * 2/1937 Phillips ..... 254/93 HP
2,804,118 A * 8/1957 Bayerkohler ..... 254/93 HP
2,985,419 A * 5/1961 Duncan ..... 254/93 HP
4,067,544 A * 1/1978 Vetter et al. ..... 254/93 HP
4,143,854 A * 3/1979 Vetter ..... 254/93 HP
6,082,708 A * 7/2000 Mullican et al. ..... 254/93 HP

* cited by examiner

*Primary Examiner*—Robert C. Watson
(74) *Attorney, Agent, or Firm*—Richard A. Ryan

(57) ABSTRACT

A resilient air compressible apparatus with a resilient member formed from a hollow cylinder having a rigid disk disposed in the interior of the cylinder at each end, a second rigid disk disposed at the exterior of the cylinder at each end, and a portion of the resilient member interposed between the pairs of rigid disks. The resilient member is formed from multiple layers of resilient material, such as rubber and reinforced rubber. A bonding agent is used to bond the resilient member to the rigid disks. Compressed air enters the interior of the resilient member through an inlet member. The apparatus can be used to as a lifting device by utilizing bottom and top lifting surface members. For safety and control purposes, the lifting device can include a control valve that does not allow the user to over-inflate the lifting device.

16 Claims, 8 Drawing Sheets

RESILIENT AIR COMPRESSIBLE APPARATUS

CROSS-REFERENCE TO RELATED APPLICATIONS

This application is a continuing application of U.S. patent application Ser. No. 09/316,915 filed May 20, 1999, now abandoned.

BACKGROUND OF THE INVENTION

1. Field of the Invention

This invention relates to an apparatus and method of making resilient air compressible apparatus, more particularly, this invention is an apparatus and method of making air compressible apparatus that are used to lift objects and can withstand pressure and shock.

2. State of the Art

Rubber bumpers, cushions, air compressible apparatus and the like have been used for many applications. Some of these applications require air to be drawn in and out, in air compressible apparatus fashion, but others require a constant air amount to provide resistance as the volume of the item is changed. These products tend to be used in failure sensitive applications, for example, as shock absorbers in vehicular applications or as the lift provider for jacks and the like. Consequently, one of the constant problems with these products is the expense required to create a high quality product. Therefore, there exists a need to build a high quality failure resistant device that is inexpensive, does not require a lot of material, is fairly easy to reproduce, yet results in a high quality product.

In most of the applications now developed for the conventional cushions, rubber deformable section is held onto a frame by a bead, an embedded wire molded into the rubber portion that fits into a receiving part of the frame. Although this standard way of molding rubber has worked satisfactorily for years, beads are known to separate from the frame, causing a potential for failure of the device. Examples of the conventional construction are found in Engineering Manual & Design Guide Firestone Products Company, Natalville, Ind. (date of publication unknown) and the Vehicular Applications Engineering Manual Goodyear Air Spring Applications, Greenburg, Ohio (date of publication unknown). The bead referred to above will be exemplified on page 6 of the Firestone publication and page 13 of the Goodyear publication. Although neither publication is represented as being exhaustive in its coverage of possible configurations for the rubber and metal interface, the only one shown is one variation or another of the bead type joint.

A variation on the cushion theme is the use of the air compressible apparatus as a lifting device in a jack or the like. One such application is shown in U.S. Pat. No. 6,082,708, the disclosure of which is incorporated herein. A bead joint is shown as the preferred embodiment. Therefore the ends of the rubber member are not affixed to the lifting plate. Although the bead joint usually works well in such applications, it may fail unexpectedly.

The air compressible apparatus, as defined in this invention, is a resilient object that is able to withstand both high pressure and shock. This invention provides for a method to make resilient air compressible apparatus with little material, is inexpensive, not laborious, and easy to manufacture. The final products are resilient air compressible apparatus made of high quality materials that have a long useful life.

Once made, the resilient air compressible apparatus may be filled with air and used as a lifting mechanism to lift objects, such as a car. Although air is commonly used to fill air compressible apparatus, this invention, as broadly used herein, also provides for the use of liquids to fill the air compressible apparatus. The use of air compressible apparatus in pneumatic springs are not uncommon. In fact, the earliest available records of using air compressible apparatus in pneumatic springs is in 1847. However, as technology increased, so did the formation and application of the air compressible apparatus.

Resilient air compressible apparatus may also be used as pneumatic springs or shock absorbers. The resilient air compressible apparatus utilize the pressure of the gas as the force medium of the spring. The compressibility of the gas provides the desired elasticity for suspension use in machines such as delicate equipment, hydraulic power units, vibrating instruments, vehicles to reduce the amount of road shock and vibration and other similar applications. The resilient air compressible apparatus may also be used to separate large objects. For example, the air compressible apparatus may be used to separate two metal components, hence acting as a separator and a pneumatic spring.

As stated above, the use of air compressible apparatus in pneumatic springs are not uncommon. However, the air compressible apparatus used today require additional materials to build and are therefore costly and require more labor hours to build. For example, some air compressible apparatus used today require girdle rings or girdle hoops, which this invention does not require. Bead plates are also additional materials required by the air compressible apparatus used today, but not required by this invention.

SUMMARY OF THE INVENTION

This invention provides an apparatus and method for lifting items or buffering items against shock using an air compensable apparatus that includes two rigid ends having the resilient material sandwiched therein, and a resilient body. In a first aspect of this invention, the resilient air compressible apparatus has a resilient member formed from a cylinder of resilient material with a first end and a second end. The cylinder defines an interior and an exterior. The apparatus includes a plurality of rigid disks each having a top surface and a bottom surface. In the preferred embodiment, the top surfaces are planar or smooth and the bottom surfaces are shaped and configured to be able to grip a portion of the resilient material between opposing bottom surfaces on pairs of rigid disks. The first rigid disk is disposed in the interior at the first end of the resilient member with the bottom surface facing upwardly. The second rigid disk is disposed on the exterior of the first end of the resilient member with the bottom surface facing downwardly positioned substantially over the first rigid disk and substantially aligned therewith. A portion of the first end of the resilient member is interposed between the bottom surface of the first rigid disk and the bottom surface of the second rigid disk. A third rigid disk is disposed in the interior of the second end of the resilient member with the bottom surface facing downwardly. A fourth rigid disk is disposed on the outside of the second end of the resilient member with the bottom surface facing upwardly and positioned substantially over the third rigid disk and substantially aligned therewith. A portion of the second end of the resilient member is interposed between the bottom surface of the third rigid disk and the bottom surface of the fourth rigid disk.

A passageway for the entrance and exit of air can be disposed in the fourth rigid disk and continue through the third rigid disk to communicate with the interior of the resilient air compressible apparatus. Alternatively, the apparatus can include a bottom plate connected to the fourth rigid disk. The bottom plate can have the passageway and include the inlet used to connect to a supply of compressed air. The inlet can be suitable for connecting to a rubber hose that connects to the supply of compressed air. The resilient member can comprise at least a first layer of resilient material bonded to a second layer of resilient material. In the preferred embodiment, the resilient member is formed from a multiple layers of rubber and reinforced rubber material.

In another aspect of this invention, the resilient air compressible apparatus described above is utilized in a lifting apparatus having the resilient air compressible apparatus disposed between a bottom lifting surface member and a top lifting surface member. The resilient air compressible apparatus has a first side and a second side. The first side of the resilient air compressible apparatus is connected to the top lifting surface member and the second side of the resilient air compressible apparatus is connected to the bottom lifting surface member. An inlet for admitting pressurized air into the resilient air compressible apparatus is connected thereto. For safety and control purposes, a control valve is disposed between the inlet and a source of pressurized air. For additional lift, a single resilient air compressible apparatus can be combined with a second resilient air compressible apparatus that is in constant air communication with the first compressible apparatus. A bottom side wall can be peripherally disposed about the bottom lifting surface member and a top side wall can be peripherally disposed about the top lifting surface member. If desired or determined to be necessary depending on the application of the lifting apparatus, the top and bottom side walls can have a plurality of support members thereon.

BRIEF DESCRIPTION OF THE DRAWINGS

In the drawings which illustrate the best modes presently contemplated for carrying out the present invention.

DETAILED DESCRIPTION OF THE PREFERRED EMBODIMENT

Figure 1:
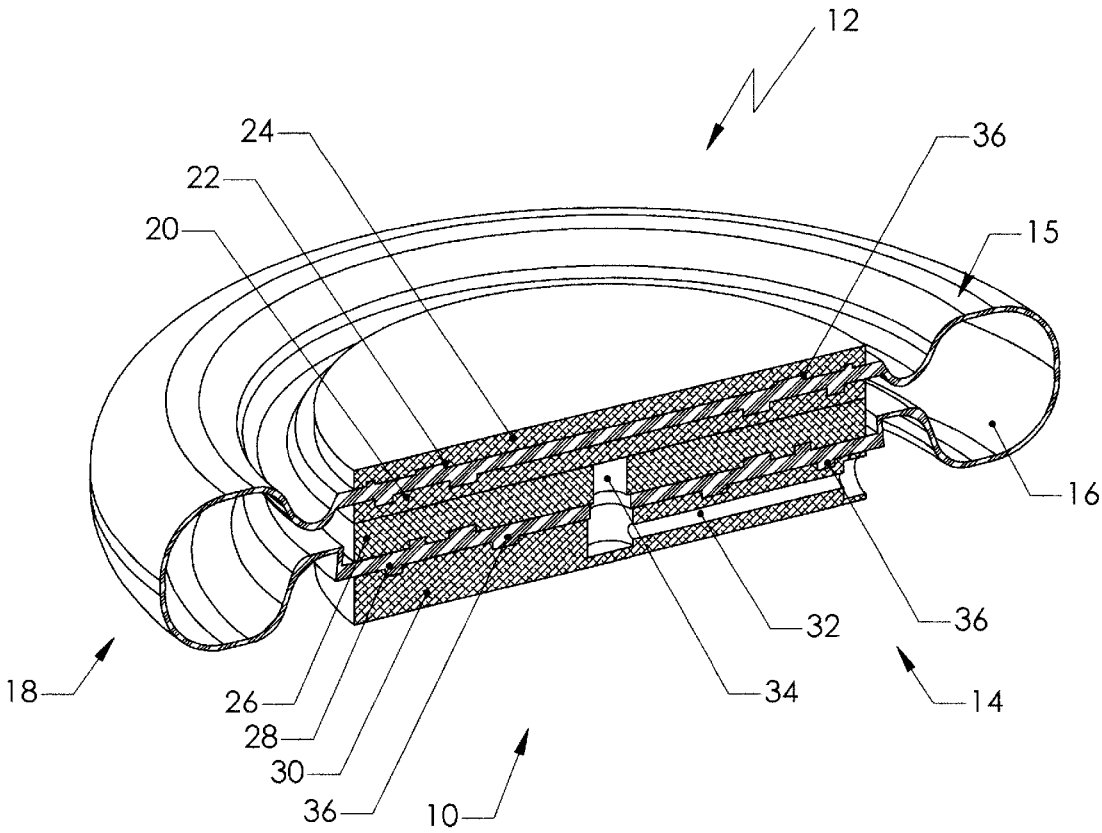
FIG. 1 shows a partially cut-away perspective view of an embodiment of the present invention.

Referring to FIG. 1, a resilient air compressible apparatus 10 has a first side 12 and a second side 14 with a resilient member 15 defining an interior 16 and an exterior 18. Proximate the first side 12 is a first disk 20 disposed on the interior 16 of 20 apparatus 10, a first intermediate resilient material layer 22, and a second disk 24 disposed on the exterior 18 of the apparatus 10. The first disk 20 and the first intermediate resilient material layer 22 are bonded by an adhesive material joined together to prevent slippage of the resilient material layer 22 relative to the first disk 20. Similarly, the second disk 24 is bonded to the resilient material. Proximate the second side 14 is a third disk 26 disposed on the interior 16 of the apparatus 10, a second intermediate resilient material layer 28, and a fourth disk 30 disposed on the exterior 18 of the apparatus. The third disk 26 and the resilient material layer 28 are bonded together to prevent slippage of the resilient material layer 28 relative to the third disk 26. Similarly, the fourth disk 30 is bonded to the resilient material layer 28. In the embodiment shown in FIGS. 1 through 3, although a favored embodiment not the preferred embodiment, the fourth disk 30 includes an air flow passageway 32 to allow air to pass from the exterior 18 of the apparatus 10 to the vertical air passageway 34 and the interior 16.

Figure 7:
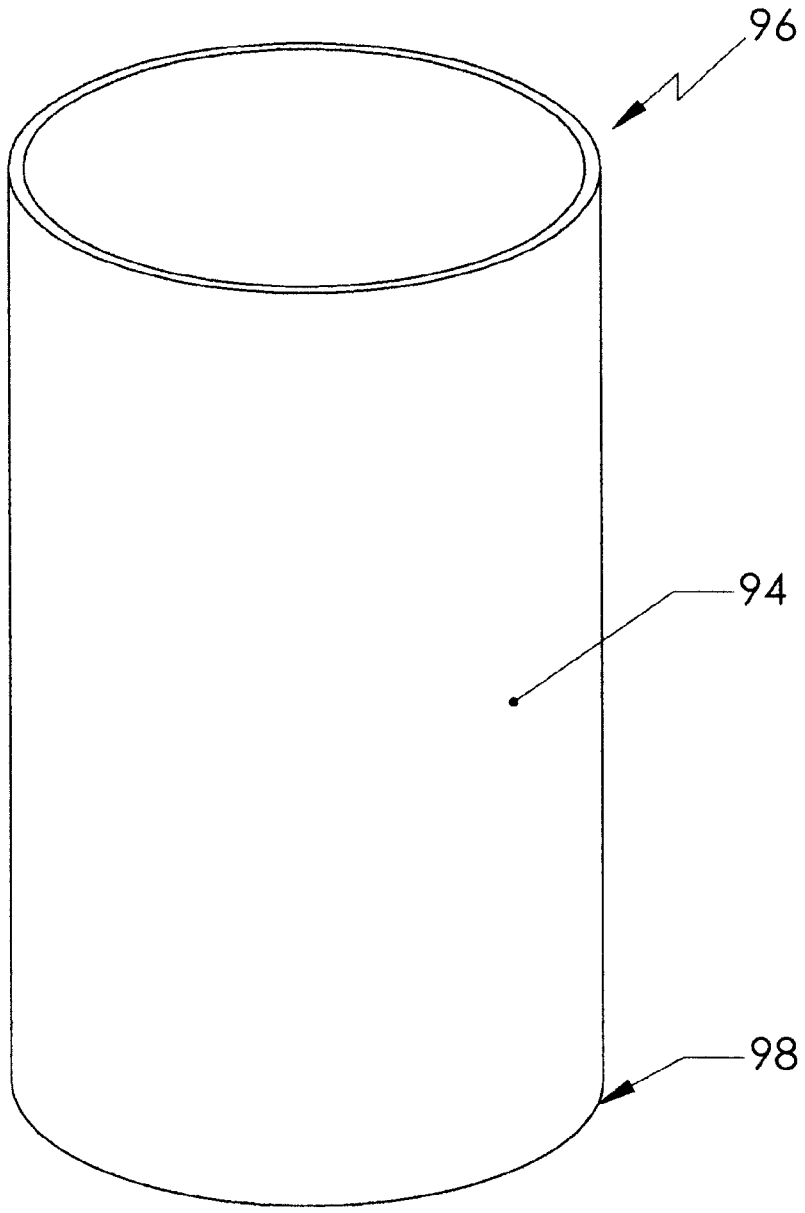
FIG. 7 shows a perspective view of the resilient material used for the fabrication of this invention formed into a cylinder before any assembly has been done to form the resilient air compressible apparatus of the present invention.
Figure 8:
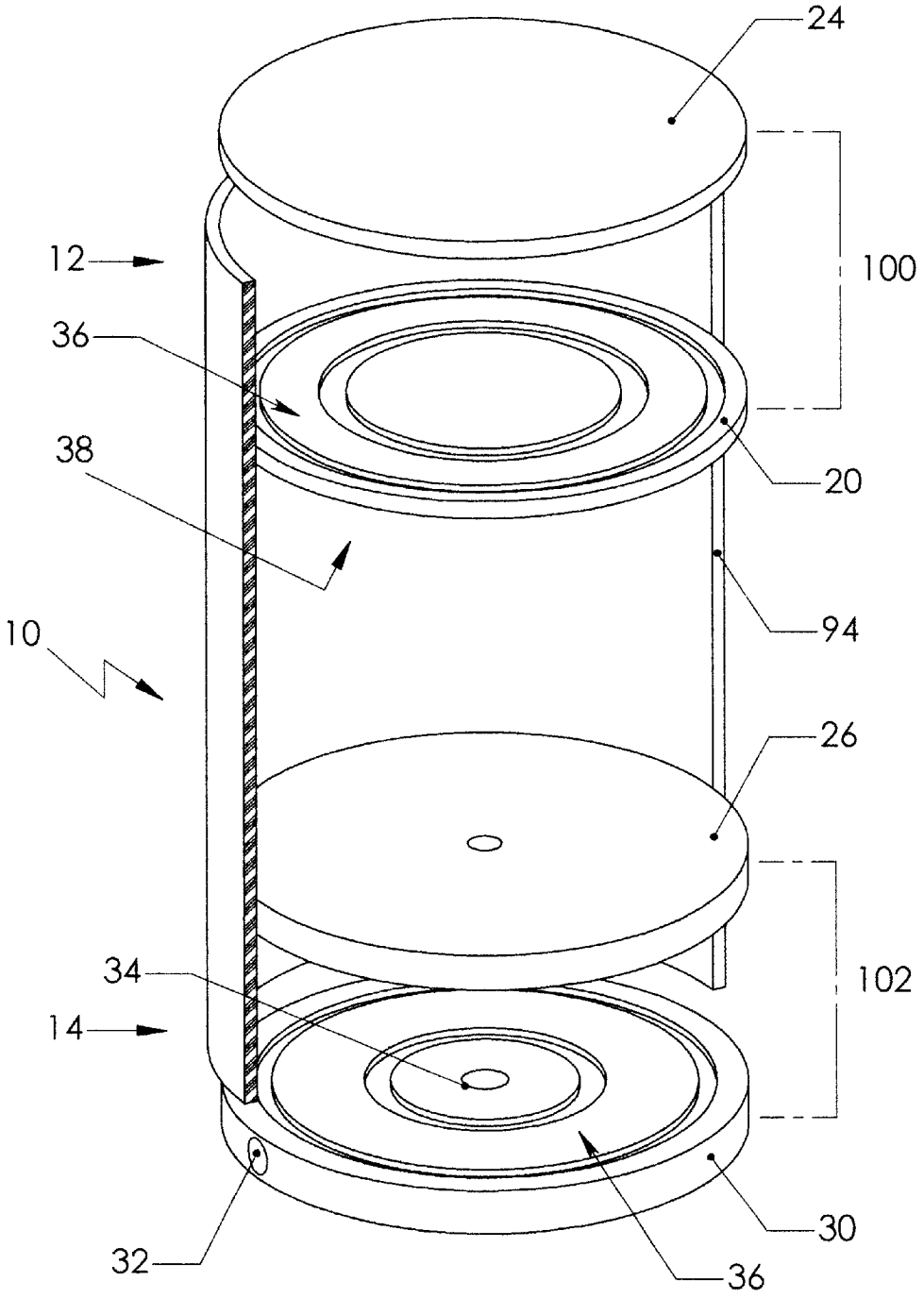
FIG. 8 shows a perspective exploded view of the elements required, and their relative locations, to fabricate the resilient air compressible apparatus of the present invention.

Each of the rigid disks 20, 24, 26 and 30 have a molded bottom surface 36 and a smooth top surface 38. As best shown in FIGS. 7 and 8, molded bottom surface 36 can comprise one or more concentric protrusions of different diameters. Other shaped configurations are also possible. As discussed below, the purpose of the molded bottom surface is to form a nearly interlocking pattern to firmly grip the resilient material layers 22 and 28 between the rigid disks 20/24 and 26/30, respectively, to prevent slippage thereof. The interlocking pattern creates a serpentine effect for the resilient material layers 22 and 28 to more firmly hold them in place. In the preferred embodiment, however, the molded bottom surfaces 36 of the first 20 and second 24 disks, on the one hand, and the third 26 and fourth 30 disks, on the other, do not form a meshing pattern, although this is not precluded, in order to provide sufficient room for the resilient material layers 22 and 24 therebetween. As shown, when the resilient material layers 22 and 28 are gripped by the rigid disks, the resilient material 15 forms a semi-toroidal shell which is made airtight by being sealed at its ends (as described in the method of making the apparatus 10 below). Although, the resilient air compressible apparatus 10 may be in the form of any other shape such as a square, triangular, or rectangular, or the like, the preferred semi-toroidal shell has the advantages of being more stable when used as a support and is easier to make than other shapes.

It is preferred that resilient member 15 for the resilient air compressible apparatus 10 be made from a material that is flexible and expandable, such as rubber. However, there are many other materials from which to chose from, such as latex, polymers such as neoprene and nitrile, and all thermoplastic rubbers or thermoplastic elastomers, and the like. Moreover, the material for resilient member 15 may be reinforced with fiber, fiber-like materials or other reinforcing materials to provide the strength and support required for the resilient member 15. The reinforcing material may be polyester, nylon, fiberglass, steel thread, Kevlar, or other materials. To provide additional strength and useful life to the resilient air compressible apparatus 10, the resilient member 15 may be made from several layers of the resilient material or additional strengthening reinforced material may be added to the resilient material. In the preferred embodiment, the resilient member 15 is multi-layer composite material comprised of an outer most layer of rubber (with no reinforcement), four layers of polyester-reinforced rubber and an innermost layer of rubber. The material is obtained in sheet form and bonded together to form a single layer of resilient material that is shaped and formed into resilient air compressible apparatus 10, as discussed below. It is preferred that any reinforcement be positioned on a bias between about thirty (30) degrees and sixty (60) degrees.

When the rigid disks 20, 24, 26 and 30 are sealably connected to the resilient material layers 22 and 28, a pressurizable chamber is formed within the interior 16 of air compressible apparatus 10. In the preferred embodiment, each of the rigid disks are constructed of metal. However, the rigid disks may also be made from aluminum, polymer material, plastic, or any other materials which may provide for the pressurized chamber within the air compressible apparatus. Although all the rigid disks may be made out of materials other than metal, it is preferred that the exterior disks, second disk 24 and third disk 30, be made out of metal materials for strength, stability and durability purposes. The interior rigid disks, the first disk 20 and third disk 26, may be made out of lighter weight materials, such as plastic, to reduce the overall weight of apparatus 10. As discussed above, to provide for the intake and out take of air, an air passage 32 may be formed, such as during the casting process, though one or more of the rigid disks. An appropriate bonding material suitable for securely bonding rigid disks 20, 24, 26, and 30 to resilient material layers 22 and 28 should be selected. In the preferred embodiment, utilizing the resilient member 15 and metal rigid disks described above, the inventors have found that CHEMLOK®, a heat activated adhesive material available from Lord Corporation in Cary, N.C., provides a very effective rubber to metal adhesive for bonding resilient material layers 22 and 28 to the rigid disks.

Figure 2:
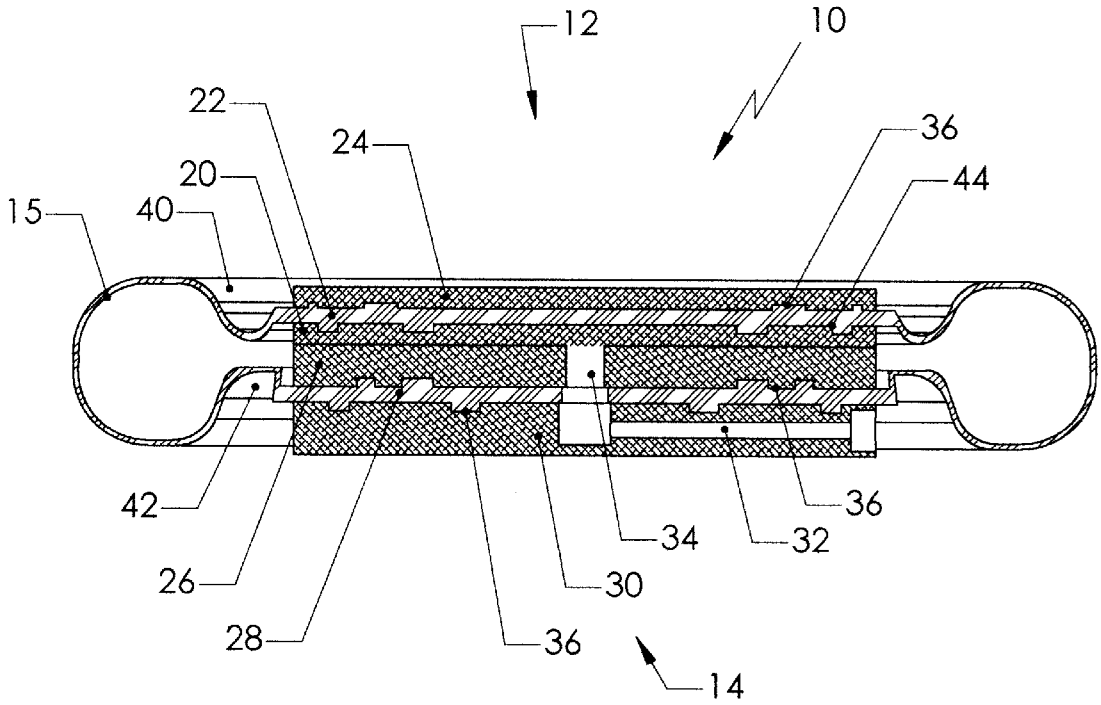
FIG. 2 shows a side cut-away view of the embodiment shown in FIG. 1.

Referring now to FIG. 2, the first disk 20 is disposed below the second disk 24. The resilient material layer 22 of the first side 12 of the apparatus 10 is sandwiched between the first 20 and second 22 disks, and held firmly by the molded features of molded surface 36. On the second side 14 of the apparatus 10, the third disk 26 is disposed above the fourth disk 30, and similarly, the resilient material layer 28 is sandwiched therebetween. The air flow passage-way 32 is molded in the fourth disk 30, and a vertical air passageway 34 is molded into the fourth disk 30 and continues into the third disk 26. The toroidal-shaped resilient member 15 does not touch itself at the folds 39 (i.e., the inward portion of the bend at the first end 40 and the inward portion of the bend of the second end 42 do not touch). The use of the folds 39 allows for more resilient member 15 to provide increased stroke or lift without increasing the overall dimensions of apparatus 10. As shown in FIG. 2, when the resilient air compressible apparatus 10 of the present invention is completely collapsed, the first disk 20 and the third disk 26 are in contact at interface 44.

Figure 3:
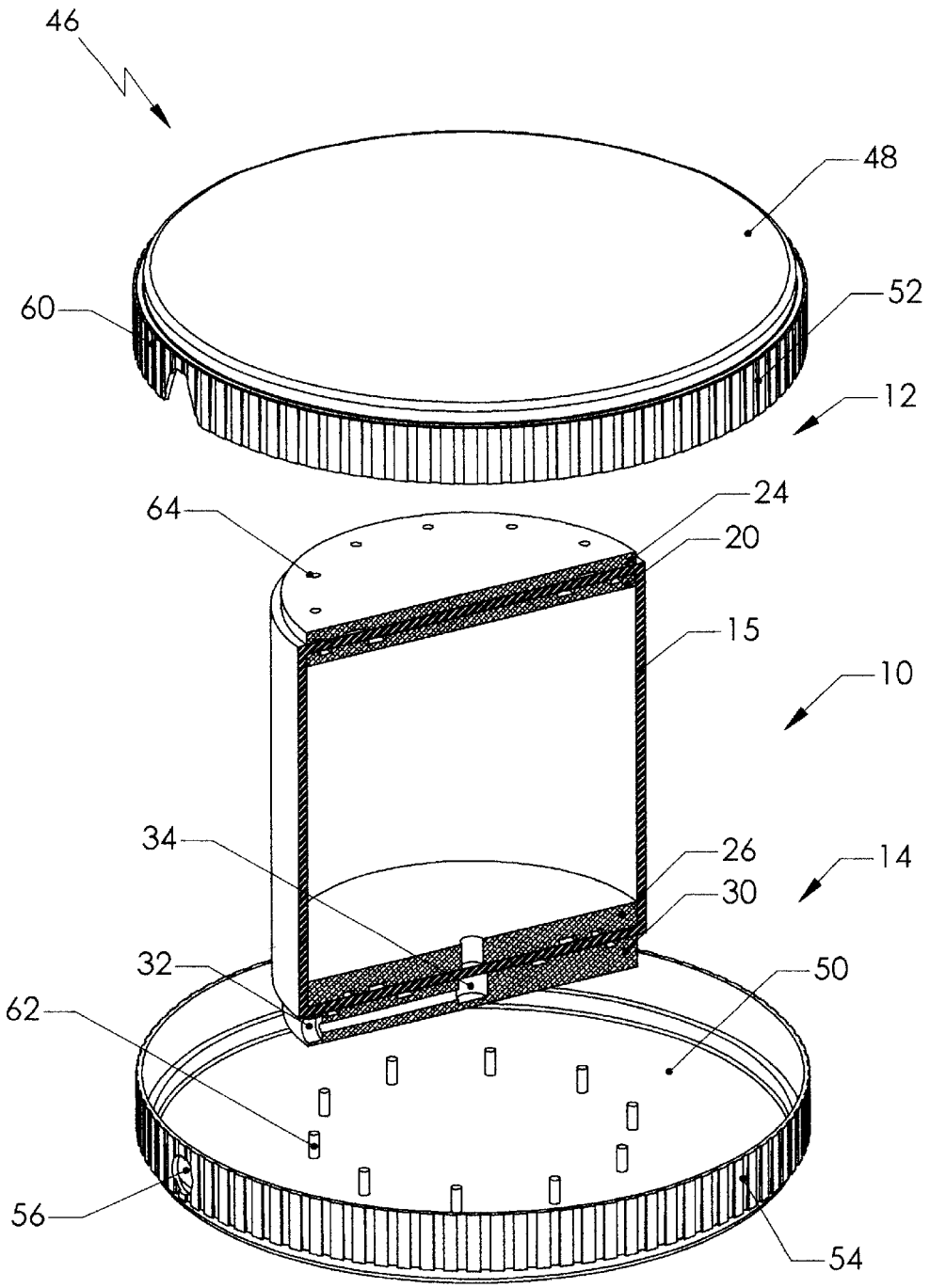
FIG. 3 shows a partially cut-away view of the embodiment of FIG. 1 showing the resilient air compressible apparatus disposed between the top and bottom lifting surface members.

The air compressible apparatus 10 of this invention is useful as a lifting device 46. Referring now to FIG. 3, with sufficient air pressure the apparatus 10 can be completely extended. The first 20 and second 24 disks, and the first end 12 in general is lifted above the third 26 and fourth disks 30 and the second end 14. The air required for the extension and deformation of the toroidal shape shown in FIG. 1 and FIG. 2 enters the interior 16 of the apparatus 10 through the air flow passage-way 32. The air is provided by an external source of compressed air (not shown).

In a preferred embodiment of the lifting device 46 using the apparatus 10 of the present invention, the device 46 would have a top lifting surface member 48 and a bottom lifting surface member 50. The top lifting surface member 48 attaches to the second disk 24, and the bottom lifting surface member 50 attaches to the fourth disk 30. The lifting surface members 48 and 50 protect the resilient member and the disks from abrasion and the like resulting from utilizing device 46 on the ground or other surfaces and against items to be lifted (i.e., automobiles). The top 48 and/or bottom 50 lifting surface members can be shaped and configured to conform to the surface from which the object is being lifted or the object to be lifted, while not requiring any modification of the resilient member 15 or the disks 20, 24, 26 and 30. For instance, the top lifting surface member 48 can have one or more saddle-shaped indentations to enable it to better support the object to be lifted (i.e., a tubular shaped axle). Alternatively, the top lifting surface member 48 can comprise removable inserts (not shown) that allow the user to select an insert that is appropriately shaped and configured for the object(s) to be lifted. The top surface lifting member 48 can have a top side wall 52 peripherally disposed about the top surface lifting member 48 and the bottom surface lifting member 50 can have a bottom side wall 54 peripherally disposed about the bottom surface lifting member 50. It is preferred that when the air compressible apparatus is completely deflated, the top side wall 52 of the top surface member 48 and the bottom side wall 54 of the bottom surface member 50 touch or overlap in order to provide a closed container for protection of the resilient member 15.

In the preferred embodiment, the top lifting surface member 48 and the bottom lifting surface member 50 are constructed of a high impact plastic, metal or composite material, such as fiber or mineral reinforced plastics, that are of sufficient rigidity and strength to support the object to be lifted. The top lifting surface member 48 and the bottom lifting surface member 50 can be made to be nearly identical except for opening 56 to one or both to surface members 48 and 50 to accommodate access to inlet 58 for filling and releasing air from the interior 16 of resilient air compressible apparatus 10 through the safety system discussed below. Inlet 58 can be sized and configured to allow the user to securely attach a tubular air hose thereon for deliver of compressed air to the interior 16 of resilient member 15. For instance, as shown in FIG. 4, inlet 58 can be have a barb shape as is common for connecting plastic hoses to inlets.

As shown in FIG. 3, either the top 48 or bottom 50 lifting surface member, or both, can have a plurality of radially and/or circumferentially disposed support members 60 that provide structural support to the top lifting surface member 48 and the bottom lifting surface member 50. Support members 60 can be attached to or molded as part of top 52 and bottom 54 side walls. Although shown in the drawings as round in shape, both the top 48 and bottom 50 lifting surface members can be square, rectangular or any other shape that provides sufficient stability for lifting an object. Round top 48 and bottom 50 lifting surface members, the preferred embodiment, has the advantage of generally being more stable when lifting loads and easier to make than other shapes.

Top 48 and bottom 50 lifting surface members are attached to second 24 and fourth 30 rigid disks, respectively. In the preferred embodiment, as shown in FIGS. 3 and 4, a plurality of small plastic insert pins 62 are formed as part of top 48 and bottom 50 surface members to fit into a corresponding number of holes 64 in the second 24 and fourth 30 rigid disks (or as shown in FIG. 4, the bottom plate 66 attached to the fourth rigid disk 30). Pins 62 should be sized and configured to tightly fit into holes 64 so as to securely hold top 48 and bottom 50 surface members onto the second 24 and fourth 30 disks, respectively. If desired, the pin/hole combination can be such that the top 48 and bottom 50 surface members are removably attached to disks 24 and 30. Alternatively, top 48 and bottom 50 surface members can be attached to disks 24 and 30 through the use of rivets, bolts, screws, adhesives or other securing mechanism that can securely and, if desired, removably connect top 48 and bottom 50 surface members to disks 24 and 30.

Figure 4:
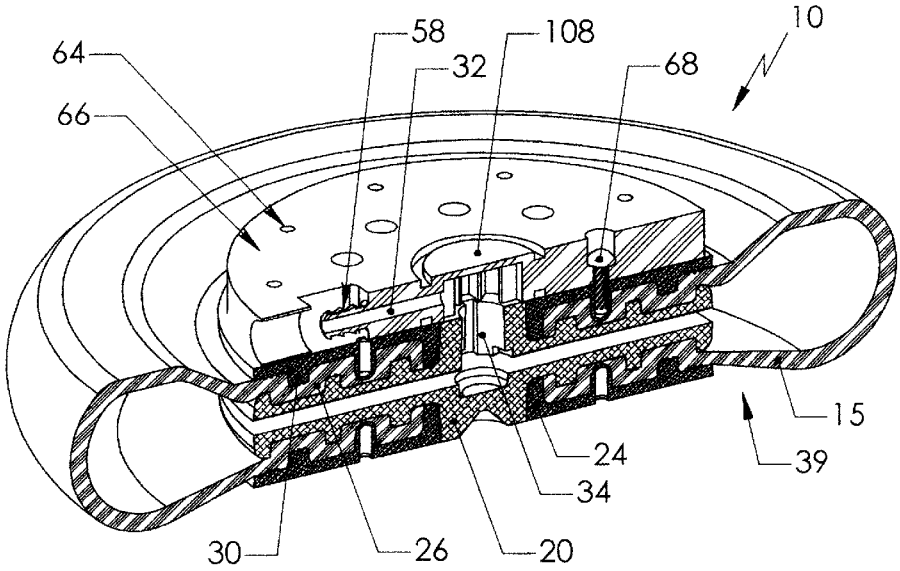
FIG. 4 is a bottom/side cut-away perspective view of the preferred embodiment of the resilient air compressible apparatus of the present invention utilizing a bottom air plate affixed to the fourth rigid disk.

In the preferred embodiment of the present invention, shown in FIG. 4, apparatus 10 includes a bottom plate 66 connected to the fourth disk 30. In this embodiment, fourth disk 30 is not molded or formed to include air passage 32. Instead, fourth disk 30 is formed similar to the other rigid disks and formed to connect to bottom plate 66. The preferred embodiment uses a plurality of rivets 68 to securely attach the bottom plate 66 to the fourth disk 30. However, other attachment means may be used such as bolts, machine screws, snaps, pins, adhesives, and the like. In the preferred embodiment, bottom plate 66 is made out of a high impact strength plastic material similar to top 48 and bottom 50 surface members. Alternatively, bottom plate 66 can be made out of metal, fiberglass or other suitable materials. Bottom plate 66 is formed to include inlet 58 and air passageway 32, which connects to vertical air passageway 34 to allow compressed air to fill the interior 16 of resilient member 15. As discussed above, bottom plate 66 can be formed with holes 64 for accepting pins 62 on the bottom surface member 50.

The preferred embodiment for using the resilient air compressible apparatus 10 as a lifting device 46 would have a safety system to avoid over-inflation of the apparatus 10, including the resilient member 15. As discussed above and shown best in FIG. 4, the lifting device 46 has an inlet 58 for filling the resilient air compressible apparatus 10 with pressurized air to vertically expand the resilient member 15 and raise the top lifting surface member 48. The inlet 58 can be located in the center of the resilient air compressible apparatus 10, on the top lifting surface member 48, or on the bottom lifting surface member 50 (as shown in FIG. 4). The inlet port 58 should be suitable for connection to a supply of pressurized air (not shown).

Figure 6:
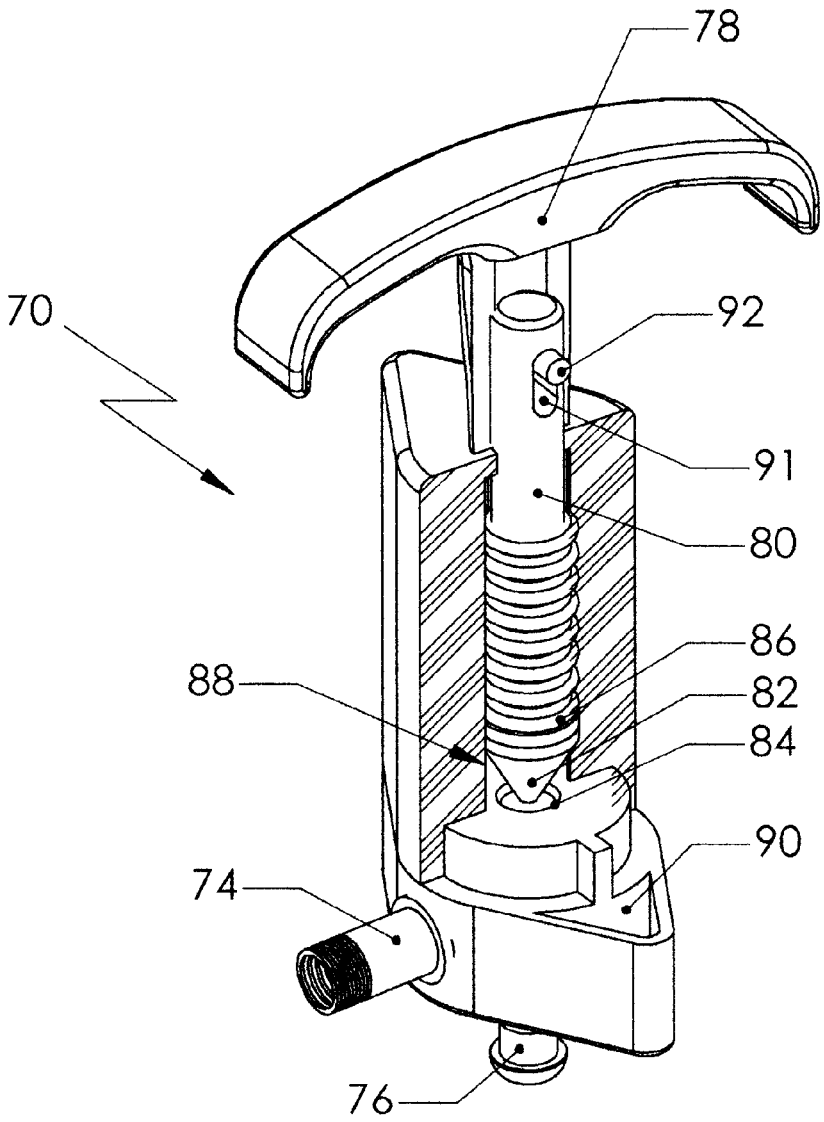
FIG. 6 is a cut-away-perspective view of the preferred control valve of the present invention.

In the preferred embodiment, the safety system comprises a control valve 70 disposed between the supply of pressurized air and the inlet port 58 to control the admittance and withdraw of pressurized air into the resilient air compressible apparatus 10. As shown in FIG. 6, the control valve 70 comprises a valve body 72 having a valve inlet 74 for connection to the supply of pressurized air and a valve outlet 76 for the flow of pressurized air to the inlet port 58 and the interior 16 of resilient member 15. To prevent overfilling of the resilient air compressible apparatus 10, the control valve 70 has a valve handle 78 with a reduced diameter shaft 80 connected to the valve tip 82 that is sized and configured to sit in the valve seat 84. The control valve 70 should be designed and configured so that when the user desires to lift an object by filling the resilient air compressible apparatus 10 with pressurized air, the user can connect the supply of pressurized air to the valve inlet 74 and the pressurized air will flow through to the interior 16 of the resilient air compressible apparatus 10 through the valve outlet 76 to raise the top surface lifting surface member 48. In the preferred embodiment a spring 86 in the valve chamber 88 holds the valve tip 82 in a closed position against the valve seat 84. In normal operation, when the object has been raised to the desired height, the user shuts off the compressed air supply. The air pressure, and therefore the height of the resilient air compressible apparatus 10, is maintained in the closed system. When the user is ready to lower the object, the handle 78 can be pulled out to unseat the valve tip 82 from the valve seat 84 to allow the pressurized air to flow into the valve passageways 90 and out to the atmosphere.

To prevent overfilling or over-raising of the resilient air compressible apparatus 10 once the interior 16 design limit pressure is reached, a spring force for spring 86 is selected that is at the desired safe design limit. Once the pressure in interior 16 of the resilient air compressible apparatus 10 exceeds the spring force, it will unseat the vale tip 82 from the valve seat 84 to allow pressurized air to flow out of the valve passageways 90 in the control valve 70, as described above. The pressure level at which the emergency release of pressurized air will occur is such that the user will be unable to force the handle 78 down to keep the valve tip 82 on the seat 84. Even if the user has sufficient strength or a device to force the handle 78 down to attempt to force more air into the resilient air compressible apparatus 10 than the designed to contain, the slot 91 and pin 92 connection would prevent any overfilling. When the handle 78 is pushed down in an attempt to put more air in, the bottom of the handle 78 will abut the top of the valve body 72 before the pin 92 abuts the top of the slot 91. The continued upward movement of the pin 92 in the slot 91 will allow the shaft 80 to continue moving upward such that the valve tip 82 will unseat from the valve seat 84 and allow air to flow out of the past passageways 90, which should be designed and configured to make it difficult for the user to block or otherwise seal. The safety system for the control valve 70 prevents the user from by-passing the safety protection to cause more pressurized air into the resilient air compressible apparatus 10 beyond its intended design limit.

In operation, the valve outlet 76 of control valve 70 is connected to inlet 58 on apparatus 10 and the deflated lifting device 46 is placed under the object to be lifted. A source of pressurized air is connected to the valve inlet 74 on control valve 70. The user then starts the flow of air from the supply of pressurized air. The spring 86 holds the valve tip 82 against the valve seat 84 to prevent the release of compressed air from control valve 70 while the user is lifting the object. As pressurized air flows into the interior 16 of the resilient air compressible apparatus 10 through the inlet port 58, the resilient air compressible apparatus 10 rises to lift the object to the desired height, at which time the user terminates the flow of pressurized air into the resilient air compressible apparatus 10. After the need for the object to be lifted is over, the user pulls on the handle 58 to allow the pressurized air to flow out of the resilient air compressible apparatus 10 and past the passageways 90 in the control valve 70. If the user attempts to overfill the inside of the resilient air compressible apparatus 10 with pressurized air by overcoming the safety mechanism in the control valve 70, the safety aspects of control valve 70 (described above) will prevent the air pressure in apparatus 10 from exceeding the design limit.

Figure 5:
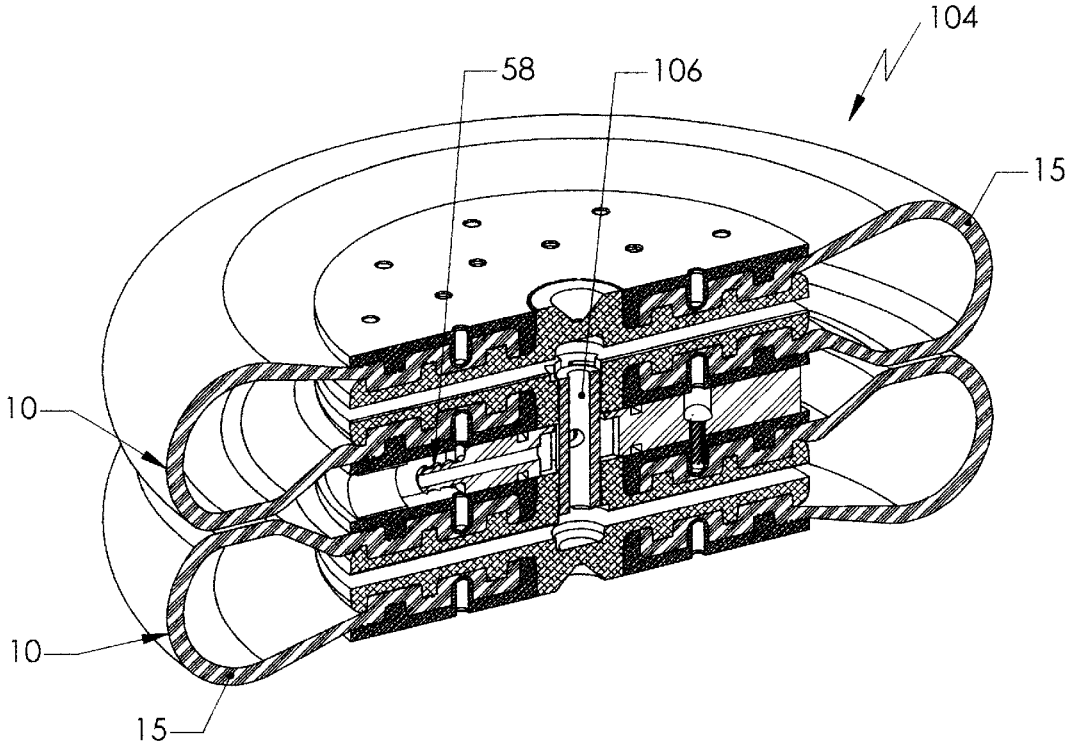
FIG. 5 is cut-away side view of an alternative embodiment of the present invention utilizing two resilient air compressible apparatuses to form a single lifting device.

In some circumstances, it may be desired to obtain additional lift than that which is practical for design of the apparatus 10 of the present invention. One method of obtaining increased height is to utilize spacer members (not shown) to increase the effective lift. The spacer members can be shaped and configured to fit on the top 48 or bottom 50 lifting surface members. The spacer members can be formed out of the same materials as top 48 and bottom 50 surface members or out of other sufficiently strong and rigid materials. As shown in FIG. 5, another way obtaining increased lift is to utilize a lifting device 104 comprised of two or more resilient air compressible apparatuses 10 disposed between a single set of top 48 and bottom 50 surface members (not shown in FIG. 5). To provide for connecting two apparatuses 10 together to form a single lifting device 104, the apparatus 10 can include a threaded receptacle inside vertical air passageway 34 that is adaptable to receiving a dual threaded connector 106 that is hollow (to allow passage of air) and suitable for connecting the two apparatuses 10 together and holding them together under pressure. As shown in FIG. 4, the apparatus 10 can be provided with a removable center cover 108 that can be removed to allow access to the threaded receptacle for connecting two apparatuses together. The fold 39 shown in FIG. 4 has been found to not work with the double resilient air compressible apparatuses due to a lack of stability as the resilient member unfolds.

Referring to FIG. 7, the resilient air compressible apparatus 10 is made by forming a hollow cylinder 94 made out of the resilient material to be used for resilient member 15. The hollow cylinder 94 of resilient material has a first end 96 and a second end 98. In general, the elements of the unformed resilient air compressible apparatus 10 are placed in the orientation shown in FIG. 8. The first disk 20 is disposed within the cylinder 94 of resilient material proximate the first end 96 such that there is a first portion 100 of the resilient material at the first end 96 which extends beyond the first disk 20. In the preferred embodiment, the first disk 20 is placed in the cylinder 94 such that the molded surface 36 is facing upwardly and the smooth surface 38 is facing downwardly. The first portion 100 of the resilient material is then folded over the first rigid disk 20. It is extremely preferable that the resilient material be bonded to the first disk 20 using adhesives or other bonding materials (as set forth above). Similarly, the third disk 26 is disposed within the cylinder 94 of resilient material such that a second portion 102 of the resilient material extends beyond the third disk 26. In the preferred embodiment, the molded surface 36 is facing downwardly and the smooth surface 38 is facing upwardly. The second disk 24 is then generally disposed above the top of the first portion 100 of resilient material with its molded surface 36 facing downwardly and the fourth disk 30 is generally disposed below the second portion 102 of resilient material with its molded surface 36 facing upwardly. The air passageway 32 and the vertical passageway 34 of the air inlet system allow air to be pumped into the interior 16 of the air compressible apparatus 10 during the forming process.

Figure 9:
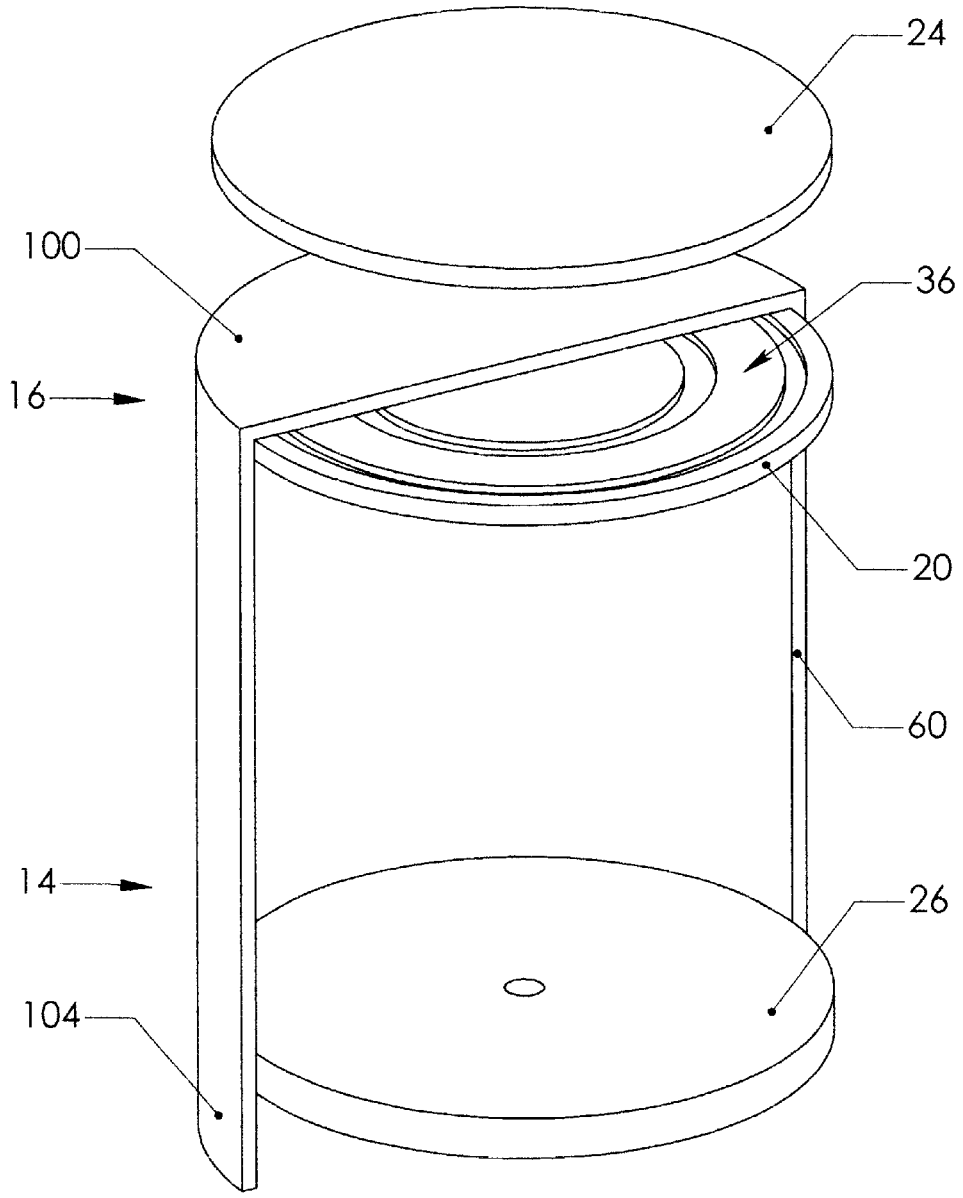
FIG. 9 shows a perspective exploded view of the of the elements required, and their relative locations, after the first end of the resilient air compressible apparatus of the present invention has been folded over the first rigid disk.

Referring now to FIG. 9, the first portion 100 of the cylinder 94 of resilient material is folded over the first disk 20. Then the second disk 24 can be pressed onto the folded first portion 100 such that it is substantially aligned with the first disk 20 and the molded surfaces 36 of the first disk 20 and the second disk 24 come together. A similar process is done to the third 26 and fourth 30 disks and the folded second portion 102 to form the air compressible apparatus 10. The second disk 24, the outer disk shown in FIG. 1 and FIG. 2, is affixed over the first disk 20. It can be bonded to the resilient material using an adhesive, or bolted or similar positive affixing method. The first end 96 of the resilient material is interposed between, or sandwiched between, the molded surfaces 36 of the first rigid disk 20 and the second rigid disk 24.

The partially formed apparatus 10 is then held by the now rigid first end 96 and the third disk 26 inserted within the still open second end 98 of the resilient cylinder 94. It is clamped from the outside of the partially formed apparatus. The second portion 102 of the resilient material is folded over the third disk 26. As before, it is extremely preferable that the third disk 26 be bonded to the resilient material. The third disk 26 is now clamped by an external clamp so the fourth disk 30 can be affixed to the second portion 102 such that it is substantially aligned with the third disk 26 and the molded surfaces 36 of the third 26 and fourth 30 disks come together. As before, the fourth disk 30 can be bonded with an adhesive or otherwise connected to the third disk 26 with the second portion sandwiched in between the molded surfaces 36 of the third 26 and fourth 30 disks.

The resilient cylinder 94 now is now unformed, but it has a rigid first 96 and second end 98. It is then carefully placed into a mold and compressed air is fed into the partially formed apparatus. The compressed air assures that the inner portions of the curve do not touch in the molding operation. The mold is now heated and the resilient material allowed to cure. The molding conditions are the usual condition for molding the selected resilient material. After a predetermined time the now formed and finished apparatus 10 is removed from the form. The top lifting member 48 and the bottom lifting member 50 can now be affixed to the apparatus 10. Obviously, many of the above-described steps can be performed simultaneously. For instance, the steps of inserting the first 20 and third 26 disks can be done simultaneously. Likewise, the steps of folding the first 100 and second 102 portions of resilient material over disks 20 and 26 can be done simultaneously. The steps of fixing the second disks 24 at the first end 96 and fixing the fourth disk 30 at the second end 98 can also be done simultaneously.

When ready, the resilient air compressible apparatus is then placed into an oven where heat and pressure are applied to form the resilient air compressible apparatus 10 into a predetermined shape. The temperature for heating the apparatus 10 is between about 240° F. and 350° F., for between 5 minutes and 25 minutes. The pressures necessary to form the resilient material into the desired shape having the desired aesthetic properties (i.e., no air bubbles or such) pressure is applied during the heating process at a level of 200 to 600 psi, depending on the property of the material and the desired temperature curing.

While there is shown and described herein certain specific alternative forms of the invention and specific examples of using the subject invention, it will be readily apparent to those skilled in the art that the invention is not so limited, but is susceptible to various modifications and rearrangements in design and materials without departing from the spirit and scope of the invention. In particular, it should be noted that the present invention is subject to modification with regard to the dimensional relationships set forth herein and modifications in assembly, materials, size, shape, and use. The appended claims are intended to encompass all such alternatives, modifications, and variations.

I claim:

1. A resilient air compressible apparatus, comprising:

a resilient member having a first end, a second end, and defining an interior and an exterior;

a first rigid disk having a smooth top surface and a bottom surface, said first rigid disk disposed on said interior of said first end of said resilient member with said bottom surface facing upwardly, said bottom surface shaped and configured to grip said first and said second portions of said resilient member;

a second rigid disk having a smooth top surface and a bottom surface, said bottom surface shaped and configured to grip said first and said second portions of said resilient member, said second rigid disk disposed on said exterior of said first end of said resilient member with said bottom surface facing downwardly positioned substantially over said first rigid disk, a first portion of said first end of said resilient member interposed between said first rigid disk and said second rigid disk;

a third rigid disk having a smooth top surface and a bottom surface, said third rigid disk disposed on said interior of said second end of said resilient member with said bottom surface facing downwardly, said bottom surface shaped and configured to grip said first and said second portions of said resilient member; and a fourth rigid disk having a smooth top surface and a bottom surface, said bottom surface shaped and configured to grip said first and said second portions of said resilient member, said fourth rigid disk disposed on said exterior of said second end of said resilient member with said bottom surface facing upwardly and positioned substantially over said third rigid disk, a second portion of said second end of said resilient member interposed between said third rigid disk and said fourth rigid disk.

2. The resilient air compressible apparatus of claim 1, wherein said resilient member comprises at least a first layer of resilient material bonded to a second layer of resilient material.

3. The resilient air compressible apparatus of claim 2, wherein at least one of said first or second layer of resilient material is strengthened with a reinforcing material.

4. The resilient air compressible apparatus of claim 1, wherein said third rigid disk and said fourth rigid disk further comprise a passageway for the entrance and exit of air.

5. The resilient air compressible apparatus of claim 4, further comprising an inlet interconnecting said passageway with a source of compressed air.

6. The resilient air compressible apparatus of claim 1, further comprising a connector in at least one of said first, second, third and fourth rigid disks for connecting said apparatus with a second resilient air compressible apparatus.

7. The resilient air compressible apparatus of claim 1, further comprising a bottom plate connected to said fourth rigid disk, said bottom plate including an inlet for connecting to a supply of compressed air.

8. A resilient air compressible apparatus, comprising:

a resilient member having a first end, a second end, and defining an interior and an exterior, said resilient member having at least a first layer of resilient material bonded to a second layer of resilient material;

a first rigid disk having a smooth top surface and a shaped bottom surface, said first rigid disk disposed on said interior of said first end of said resilient member with said bottom surface facing upwardly;

a second rigid disk having a smooth top surface and a shaped bottom surface, said second rigid disk disposed on said exterior of said first end of said resilient member with said bottom surface facing downwardly positioned substantially over said first rigid disk, a first portion of said first end of said resilient member interposed between said first rigid disk and said second rigid disk;

a third rigid disk having a smooth top surface and a shaped bottom surface, said third rigid disk disposed on said interior of said second end of said resilient member with said bottom surface facing downwardly; and fourth rigid disk having a smooth top surface and a shaped bottom surface, said fourth rigid disk disposed on said exterior of said second end of said resilient member with said bottom surface facing upwardly and positioned substantially over said third rigid disk, a second portion of said second end of said resilient member interposed between said third rigid disk and said fourth rigid disk.

9. The resilient air compressible apparatus of claim 8 further comprising a passageway in said third rigid disk and said fourth rigid disk for the entrance and exit of air, said passageway connected to an inlet for receiving air from a source of compressed air.

10. The resilient air compressible apparatus of claim 8 further comprising a connector in at least one of said first, second, third and fourth rigid disks for connecting said apparatus with a second resilient air compressible apparatus.

11. A lifting apparatus comprising:

a bottom lifting surface member;

a top lifting surface member;

a resilient air compressible apparatus having a first side and a second side, said resilient air compressible apparatus disposed between said bottom lifting surface member and said top lifting surface member, said first side of said resilient air compressible apparatus connected to said top lifting surface member and said second side of said resilient air compressible apparatus connected to said bottom lifting surface member, said resilient air compressible apparatus further comprising a resilient member and a plurality of rigid disks, said resilient member having a first end, a second end and defining an interior and an exterior, each of said plurality of rigid disks having a smooth top surface and a bottom surface, said plurality of rigid disks comprising a first rigid disk disposed on said interior of said first end of said resilient member with said bottom surface facing upwardly, a second rigid disk disposed on said outside of said first end of said resilient member with said bottom surface facing downwardly and positioned substantially over said first rigid disk, a third rigid disk disposed on said interior of said second end of said resilient member with said bottom surface facing downwardly, and a fourth rigid disk disposed on said outside of said second end of said resilient member with said bottom surface facing upwardly and positioned substantially over said third rigid disk, wherein a first portion of said first end of said resilient member is interposed between said first rigid disk and said second rigid disk and a second portion of said second end of said resilient member is interposed between said third rigid disk and said fourth rigid disk, and wherein each of said bottom surfaces are shaped and configured to grip said first and said second portions of said resilient member;

an inlet connected to said resilient air compressible apparatus for admitting pressurized air therein; and a control valve disposed between said inlet and a source of pressurized air.

12. The resilient air compressible apparatus of claim 11, wherein said third rigid disk and fourth rigid disk further comprises a passageway for the entrance and exit of air.

13. The resilient air compressible apparatus of claim 11 further comprising a bottom plate connected to said fourth rigid disk, said bottom plate including an inlet for connecting to a supply of compressed air.

14. The lifting apparatus of claim 11, wherein said resilient member comprises at least a first layer of resilient material bonded to a second layer of resilient material.

15. The lifting apparatus of claim 11, wherein said bottom lifting surface member further comprises a bottom side wall peripherally disposed about said bottom lifting surface member and said top lifting surface member further comprises a top side wall peripherally disposed about said top lifting surface member.

16. The lifting apparatus of claim 11, wherein said control valve comprises pressure relief means for releasing air from said resilient air compressible apparatus when the pressure therein exceeds a predetermined amount.

* * * * *